US006073814A

United States Patent [19]

Fuchs

[11] Patent Number: 6,073,814

[45] **Date of Patent: *Jun. 13, 2000**

[54] DISPENSER FOR DISCHARGING MEDIA

[75] Inventor: Karl-Heinz Fuchs, Radolfzell, Germany

[73] Assignee: Caidéil M.P. Teoranta, Ireland

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,603

[22] PCT Filed: Nov. 10, 1995

[86] PCT No.: PCT/EP95/04426

§ 371 Date: Apr. 11, 1996

§ 102(e) Date: Apr. 11, 1996

[87] PCT Pub. No.: WO96/15855

PCT Pub. Date: May 30, 1996

[30] Foreign Application Priority Data

Nov. 19, 1994 [DE] Germany ..... 44 41 263

[51] Int. Cl.[7] ..... B67D 5/42

[52] U.S. Cl. ..... 222/321.1; 222/321.9; 222/341

[58] Field of Search ..... 222/207, 212, 222/215, 321.1, 321.7, 321.9, 341

[56] References Cited

U.S. PATENT DOCUMENTS

| | | | |
|---|---|---|---|
| 3,235,135 | 2/1966 | Robert et al. | 222/207 |
| 4,260,079 | 4/1981 | Cary et al. | 222/209 |
| 5,205,441 | 4/1993 | Andris | 222/207 |
| 5,238,156 | 8/1993 | Andris | 222/207 |
| 5,265,771 | 11/1993 | Meshberg . | |
| 5,303,867 | 4/1994 | Peterson | 222/207 X |
| 5,316,198 | 5/1994 | Fuchs et al. | 222/341 X |

FOREIGN PATENT DOCUMENTS

| | | | |
|---|---|---|---|
| 2380077 | 9/1978 | France . | |
| 2380076 | 10/1978 | France | 222/341 |
| 3225910 | 1/1984 | Germany . | |
| 8702986 | 2/1987 | Germany . | |
| 8713891 | 10/1987 | Germany . | |
| 8905137 | 4/1989 | Germany . | |
| 39 07 964 | 9/1990 | Germany . | |
| 9106417 | 5/1991 | Germany . | |
| 39 42 365 | 6/1991 | Germany . | |
| 4015367 | 11/1991 | Germany . | |
| 42 07 800 | 9/1993 | Germany . | |
| 295 06 682 | 8/1995 | Germany . | |
| WO91/03321 | 3/1991 | WIPO . | |
| WO94/20221 | 9/1994 | WIPO . | |

OTHER PUBLICATIONS

Weber, Anton: Die Kunstsoffe und das Automobil. In: ATZ Automobiltechnische Zeitschrift 97, 1995, 9,S.589–592.

JP 5–229578 A., In: Patents Abstracts of Japan, M–1528, Dec. 14, 1993, vol. 17, No. 682.

*Primary Examiner*—Kenneth Bomberg

*Attorney, Agent, or Firm*—Quarles & Brady LLP

[57] ABSTRACT

A discharge apparatus (1) comprises within the pump housing (2) an integral full-length working member (10) having spring sections (28, 29, 30) and sections located between these which form a valve housing (18), fastening members for connecting to a piston (12) and the like. The spring section in each case may be configured as a helical or torsion spring having a closed spring jacket, thus resulting in simple manufacture and simple assembly with high functional reliability.

28 Claims, 5 Drawing Sheets

DISPENSER FOR DISCHARGING MEDIA

CROSS REFERENCE TO RELATED APPLICATIONS

This is a national phase application (35 USC 371) of PCT/EP95/04426 filed Nov. 10, 1995.

BACKGROUND OF THE INVENTION

1. Field of the Invention

The invention relates to a discharge apparatus for flowable and/or other media which e.g. before or during the discharge procedure may be gaseous, liquid, pasty and/or powderlike. Discharge may be of only a single media component or separate components simultaneously via separate discharge paths such that their start of discharge and/or their end of discharge is delayed with respect to each other.

SUMMARY OF THE INVENTION

2. Description of Related Art

The discharge apparatus comprises according to the invention at least one working member, such as a resilient element, an integral working spring or the like, which during the work, e.g. the discharge work, of the apparatus is tensioned and released and/or may cause other functions. Such functions may be control movements, return movements, closing movements, abutment functions, sliding guidance or the like. Expediently the discharge apparatus or the working member in each case is made exclusively of plastic or non-metallic materials which may be copolymerisates such as polyethylene, polypropylene or other thermoplastics, so that the component concerned is to be produced as a molding.

Furthermore, it is intended that the discharge apparatus, which is to be gripped, freely carried and simultaneously actuated single-handedly, discharges or thereby pulverizes the medium over the major part of its actuating path, particularly directly after at least partial closing of an inlet. The minimum tension of the spring in the starting and resting condition of the discharge apparatus lies preferably above 2 to 5 N and below 10 or 8 N, the tension at the start of discharge or on closing the inlet being above 10 or 15 N and below 30 or 25 N and the maximum tension at the end of the discharge procedure being above 40 or 50 N and below 100 or 80 N, respectively. The discharge apparatus may be configured very small, namely as regards its surfaces coming into contact with the media have a maximum width of 30, 20 or roughly 10 mm, whilst its length amounts to a maximum of 50 or 40 mm respectively. This length relates e.g. to the spacing between the inner bottom of a pressure space and the outer end of an actuating handle for a discharge apparatus which is to be inserted by the inner end through the bottleneck into a small bottle. The discharge apparatus is suitable for very small discharge volumes of each complete, abutment-limited discharge procedure, namely volumes of less than one, one half or three tenths of a centiliter or milliliter. The manual actuating force for a discharge procedure may then lie below 200 or 100 N respectively.

The invention is based further on the object of creating a discharge apparatus for media in which disadvantages of known configurations are avoided and/or advantages and effects of the kind described are achieved. In particular, it is intended to ensure, where applicable, a simple manufacture and/or a fully-automatic assembly and/or a very low number of components or a high functional safety even at the most varied of temperatures.

The working spring in each case may include working sections which are expediently lined up one against the other in the longitudinal direction and have for each respective length unit a differing stiffness or springiness. The working section in each case may be a resiliently deformable spring section, a non-resilient intermediate section, a non-resilient end section and/or a resilient end section. Each respective non-resilient section is expediently affected not by closely or contacting juxtaposed spring windings, but by a corresponding change in cross-section or other stiffening configurations of the working spring, so that each respective spring section may have substantially the same spring effect over its full length and up to one or both ends for each respective length unit or spring winding. Each respective spring winding forms advantageously full cross sections which in directions located transversely to each other have greatly differing extensions, e.g. in the longitudinal direction of the spring, for instance, a multiply greater cross-sectional extension than at right-angle thereto or transversely or radially to the spring axis.

Each respective working section may be configured as a completely closed or a multiply or uniformly perforated hollow jacket so that adjacent spring sections or spring windings are directly connected to each other not only via the course of the pitch, but bellows-like also in the longitudinal direction of the spring. The connecting sections are movable with respect to each other in the longitudinal direction of the spring and may adjoin each other or translate integrally into each other similar to adjoining truncated cones in the longitudinal section at an angle of maximally 90° or at acute angles, respectively.

It is particularly of advantage when the spring is loaded in torsion over its travel and thus torsional return forces materialize. These may then supplement the axial return forces so that also a relatively weakly dimensioned spring causes high spring forces or a relatively linear spring characteristic. Each respective working section may be profiled on the inner and/or outer circumference in the fashion of a single, double or multiple pitch thread as a helix or steep helix. If the inner and outer helix sections are approximately congruent, the wall thickness of the working section in this portion is approximately constant over the circumference or the axial extension, respectively. Each respective outer or inner helix may pass through at least two up to all working sections with approximately the same diameter or same pitch interruptedly or non-interruptedly, respectively so that a very simple manufacture is possible.

The pitch angle of the helix may be between 10° and 60°, particularly 20° and 45°, whereby in addition to these values a minimum or maximum value of 5°, 30°, 40° and 50° may be of advantage. When the spring is deformed so that adjacent winding sections having roughly the same diameter are in contact with each other abutted, a correspondingly slight inner material deformation or bending occurs respectively in a multi-pitch configuration having alternatingly interleaved windings of several helices. By increasing the helical pitch the resilient torsion loading may be increased, thus maintaining the spring tension even in the cases of high mechanical and thermal loading, e.g. up to at least 70° C.

Each respectively stiffened working section may then e.g. be formed by it having merely radially outside of the inner circumference other cross-sections than one or two adjacent spring sections, for example greater full cross-sections in the longitudinal and/or radial direction. The stiffened section may be axially and/or radially resilient, e.g. resilient due to cross-sectional squeezing or substantially dimensionally rigid.

The inner and/or outer circumference of each respective working section is suitable for sliding guidance on corresponding opposing surfaces with which it may be merely in line contact or edge contact or via a greater axial extension. The respective circumference is furthermore suitable for media guidance, whereby it may form together with the opposing surface a helical passage which is approximately closed via the circumference of its cross-section. The flow directions at the inner and outer circumference are thereby advantageously directed opposingly, whereby the reversal in the flow passing through may be affected in the portion of an end of or of a wall penetration of the working member. Although via the spring travel each respective helical passage or helical groove could become substantially fully closed up to the end of the spring travel, the dimensions are expediently defined so that the helical passage or the cavity of the working component always remains open.

Each of the working sections may also form a positive contact member, an abutment member, a centering member, a position lock or the like for its axial, radial and/or non-rotational locationing or that of the working spring respectively. In the longitudinal direction of the spring such working sections or stiffened working sections may be substantially shorter than at least one or all spring sections or than the one or more directly adjoining spring sections, respectively. Each respective spring section may in turn have with respect to its outer and/or inner width a larger or even a smaller length, depending on which spring travel or spring effect is needed, respectively. If the working spring is defined with a fastening section by a snap connector or the like axially and/or radially substantially with zero clearance with respect to a further component, such as a plunger, both adjoining spring sections may work totally independently of each other. In the case of an abutment section a shortening of the effective spring length or an abrupt steepening of the spring characteristic, respectively materializes following achievement of the abutment position, so that e.g. until closure of an inlet valve a lesser actuating force is needed and afterwards an increased actuating force, whereas in the return movement both spring sections located on both sides of the abutment section may be effective right from the start.

The configuration according to the invention is particularly suitable for piston or plunger pumps which e.g. comprise a pressure-dependent operating outlet valve which is located within the piston, and a valve closing body separate from the piston which executes axial working movements with respect to the piston. The valve housing is expediently configured integral with the adjoining spring section or the associated valve spring or with two up to all of the working sections of the associated working spring, respectively. If the pump is configured as a self-priming pump then it includes an inlet valve which holds the pressure or displacement chamber closed pressure-tightly during the pump stroke. The valve may be configured as an abutment-limited valve and/or as a gate valve. Its axially movable valve housing may be configured integral with each of the otherwise cited working sections of the working member.

The discharge apparatus may also be configured so that its pump chamber is not to be refilled by self-priming or return strokes, it instead containing the total supply of media of the discharge apparatus right from the start. Each of the working sections or the inner and/or outer circumference thereof respectively may be located partly or also completely outside of the medium-carrying portions, e.g. on the outside of the pump chamber, so that it in no instance comes into contact with the medium.

The discharge apparatus or the components thereof, such as the working spring or the individual working sections, may be manufactured and assembled very simply, particularly when the components are configured substantially rotationally symmetrical as well as such that for their direct interactive engagement certain components have an interactive self-centering effect when installed by movements oriented longitudinally with respect to each other and attain interactive functional engagement solely by longitudinal forces, thus enabling preassembly of assemblies to be dispensed with. For instance, the working spring and the piston may be lowered one after the other into a pump housing in both possible sequences by the force of the weight in the longitudinal direction, whereupon the positioning lock between piston and working spring is automatically engaged by application of an axial force. The piston may then form the sole, separate face closure of the housing or, for this purpose, a separate housing cover may be applied, via which again the stated axial fitting force is applicable. One such cover, which also snaps into place self-centering in the housing, may be provided at the inner und/or outer end of the pump housing. The inner end is denoted as that end respectively facing away from the outer end, this outer end being located nearer to the manual discharge actuation or the media outlet, respectively. When the inner end is connected to the associated outer end respectively , this connecting direction usually corresponds to the discharge flow direction in a main section of the outlet passage or of the pump chamber respectively, this flow direction being opposite to the pumping movement of the displacement piston.

These and further features are evident from the claims as well as from the description and the drawings, each of the individual features being achievable by itself or severally in the form of sub-combinations in an embodiment of the invention or in other fields and representing configurations which are both advantageous and patentable in their own right, for which patenting is claimed in the present:

Example embodiments of the invention are illustrated in the drawings and will be explained in more detail in the following. In the drawings:

DETAILED DESCRIPTION OF THE PREFERRED EMBODIMENTS

Figure 1:
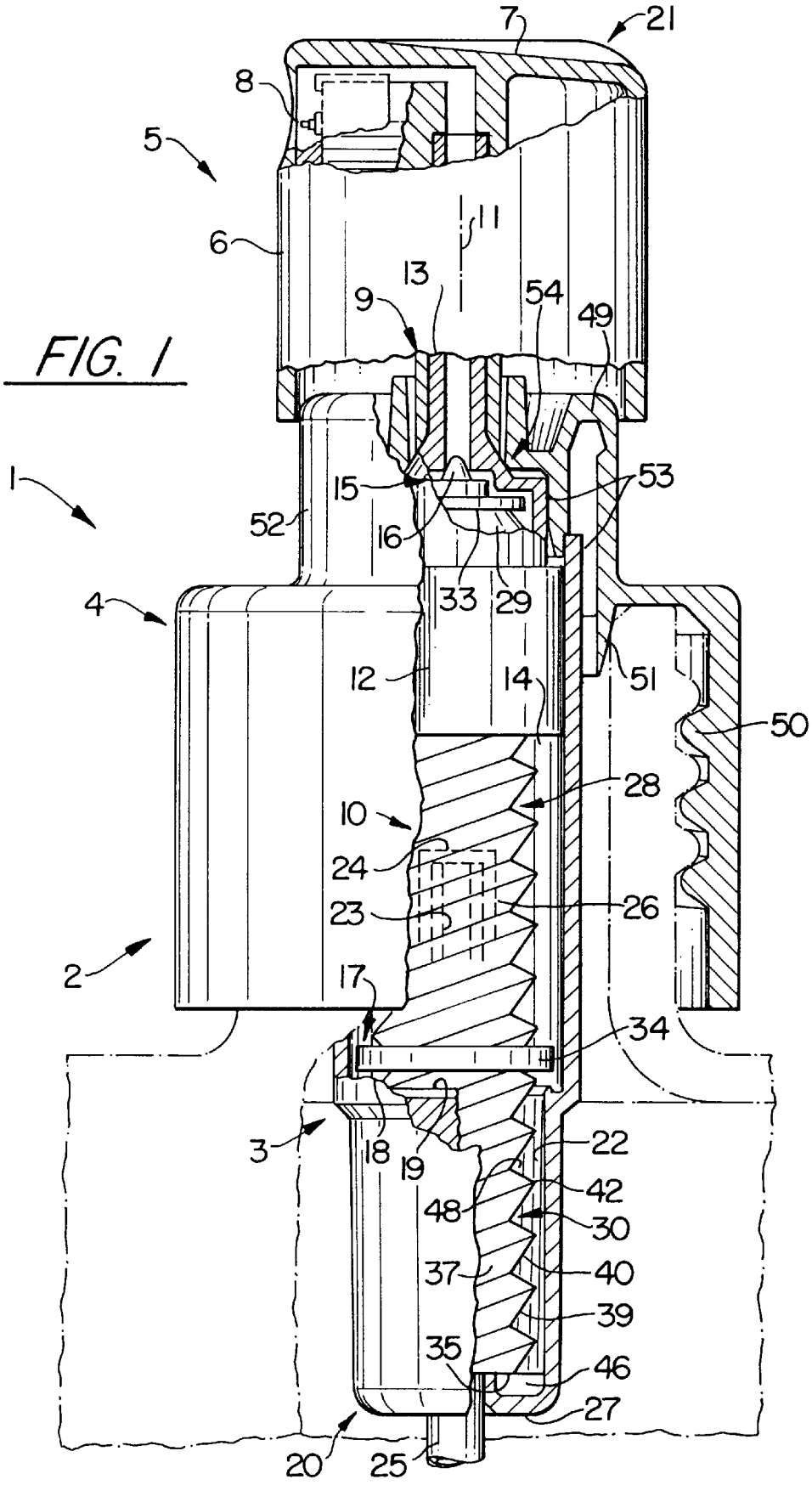
FIG. 1 shows a discharge apparatus according to the invention, partly in axial section.

The discharge apparatus 1 comprises a base body 2 to be disposed firmly located with respect to a media storage denoted dot-dashed, the base body 2 being provided for filling or through-flow of the medium. The housing-shaped base body 2 is composed of an elongated, sleeve-shaped housing part 3 and a cover 4 which closes off the outer end of the pad-shaped housing part 3 annularly and is passed through by a discharge actuator 5. At its outer end the discharge actuator 5 carries a head 6, the outermost face of which forms a pressure handle 7 and which comprises a radially oriented media outlet 8 in the form of an atomizer nozzle merging into free space. The head 6 is secured to the outer end of a piston unit 9 by axial mounting and is shiftable with this piston unit 9 synchronously with respect to the base body 2 against the inner end or against the outer end thereof, respectively.

Substantially totally jacketed and covered at the front end to the outside an elongated working unit or working spring 10 is disposed recessed within the component 3 or 4 respectively, said working unit or working spring 10 extending in its starting condition approximately over the full inside length of part 3. Arbitrary pairs of the arrangements 2 to 10 may be located axially parallel or axially the same to each other and define thereby a central middle axis 11 of the discharge apparatus 1. At the inner end the piston unit 9 forms a pad-like piston 12, which translates at the outermost end via an annular bottom wall into a tappet 13. This tappet 13 is guided through the cover 4 outwardly and carries the head 6. Each of the components 3, 4, 9, 10 may be configured integrally, so that the discharge apparatus 1 may be assembled without head 6 and, if necessary, without suction or filling tube, from only four components functionally so that medium may be pumped through the tappet 13 from the pump chamber 14 of the base housing 2 outwardly.

The piston 12 runs sealed on the inner circumference of the jacket of the housing 3 with two annular sealing lips protruding opposed and located axially spaced from each other, i.e. from an abutment-limited starting position to a pump stroke end position in which the piston 12 itself is not abutted. The piston 12 defines the pump chamber 14 at its outer face end and forms with its cavity itself a longitudinal section of the variable-volume pump chamber 14. In any stroke position the components 9, 12 and 13 may be torsionally locked by frictional or positive contact with respect to the components 2, 3 and 4 respectively.

Offset outwardly with respect to the inner and/or outer piston lip of the piston 12 an outlet valve 15 is provided within the piston unit 9 in the portion of the bottom wall of the piston 12 adjoining the tappet 13 integrally, this outlet valve opening above a limiting pressure in the pump chamber 14 automatically against return forces by a valve housing 16 lifting off from a valve seat. The valve seat is formed by an annular inner shoulder, configured integrally with the components 9, 12, 13 and forming an end abutment for the closing position of the valve housing 16, the closing movement of which is oriented towards the outer end of the discharge apparatus 1 or parallel to the direction of flow of the medium in the valve 15.

Spaced from as well as between the inner and outer end of the unit 2 and 3 respectively within the housing 3 an inlet valve 17 is provided with two coactive valve parts, namely an axially movable valve housing 18 and a valve seat 19 fixedly attached to the housing. The inner end of the discharge apparatus 1 or of the base body 2 is denoted by 20 and the outer end by 21 which is formed by the outer face of the head 6 with the discharge apparatus fully composed. Each of the stated components or each longitudinal section of one such component comprises corresponding inner and outer ends, whereby the inner end 20 may be located within the media storage, whilst the outer ends of the components 3, 4, 9, 10 are located outside of the media storage. The inlet valve 17 separates in the closed condition an inlet chamber 22 pressure-tight from the pumping chamber 14 which with valve 17 open is communicatingly connected to the chamber 22 by direct connection of the two adjoining chamber ends. The inlet chamber 22 is substantially defined exclusively by the housing 3, and an inlet passage 23 porting into said chamber via an inlet opening 24, no further valve being provided between the media inlet of the inlet passage 23 and the inlet opening 24 or the valve 17, respectively.

The inlet passage 23 is formed substantially by a flexible, hose-like uptake tube which protrudes from the inner end 20 such that media inlet is in the region of the bottom of the storage vessel. In this case, the uptake tube 25 is formed by a component separate from component 3 or 4 and disposed position-locked in a support 26 of component 3, but may also be configured integral with the said component. The tubular support 26 receives the outer end of the uptake tube 25 at the inner circumference via a connector and forms with its outer end the inlet opening 24 which may be offset axially outwards with respect to the valve 17 and axially inwards with respect to the piston 12 in its resting position. Like the tube 26 the inlet opening 24 is located substantially completely within the working member 10, the tube 26 protruding integrally only from the inner face of the bottom wall 27 of the base body which forms the inner end 20.

The working spring 10 forms a plurality of axially adjoining working sections 28 to 34, whereby directly juxtaposed sections may have differing lengths, internal widths and/or external widths as well as flexural or dimensional rigidities respectively opposed both in the radial and the axial direction. In this case the sections 28, 29, 30 are provided as axially resilient or elongatable spring sections whilst each of the sections 31 to 34 is substantially dimensionally rigid with respect to tension and compression, respectively. The sections 31, 32, 34 are intermediate sections of the working spring 10 whilst section 33 forms the outer end section of the working spring 10.

The inner end 35 of the working spring 10 is formed by the end section 30 and supported directly with respect to the base body 2 such that it always assumes with respect thereto the same axial position and/or is torsionally locked by frictional or positive contact. The working spring 10 is hollow substantially over its entire length, i.e. with full-length approximately continuous inner cross-sections, the cavity at the outer end being closed off pressure-tight by the section 33.

Also the jacket of the working spring 10 is impermeable to the medium substantially over the entire length thereof, so that only the end 35 forms a transition opening for the medium from the interior of the working spring 10 to the inlet chamber 22. The inner circumference 36 and outer circumference 37 respectively of the working spring 10 departs from the cylindrical shape in the portion of each of the sections 28 to 34 and over the axial extension thereof, whereby the outer circumference of the sections 31 to 34 may be partly or completely cylindrical, however. The inner circumference 36 is substantially over all sections 28 to 32 and 34 of consistently constant structure, namely formed as a kind of two-turn vee thread by the helices 39, so that an inner form tool following production of the working spring 10 may be easily removed therefrom. The outer circumference 37 is formed only in the portion of the sections 28 to 30, but not in the portion of the sections 31 to 34 by corresponding helices 40 of a two-turn vee thread which is located with respect to the female thread that in its portion of the jacket 38 of each section 28, 29, 30 respectively has approximately a constant wall thickness. The radial edge 41 located most inwardly of the helix 39 or the like is able to glide centrally in the portion of the support 26 on the outer circumference thereof, the same as the radial edges 42 located most outwardly of the the outer helices 40 are able to glide centrally on the inner circumference of the housing 3 or chamber 22 and/or piston 12 respectively. The sections 29 and 31 to 33 are located completely within the piston 12, the outer end of the section 28 extends into the piston 12, the section 34 like the major longitudinal portion of the section 28 is located entirely in the chamber 14 expanded with respect to chamber 22, and the section 30 is located, when the valve 17 is closed, entirely in the chamber 22, whilst when the valve 17 is open it protrudes partly into the chamber 14.

The component 10 is defined by positive contact in the longitudinal direction exclusively with respect to the component 9, 12, 13, i.e. only in the portion of the sections 31, 32 which engage via a snap connector 43 and a face end abutment in the inner circumference of the piston 12 such that they are locked in position by friction or positive contact substantially with zero clearance in both opposed axial directions and/or directions of rotation. The sections 31, 32 protrude as annular collars from the outer circumference of the sections 28, 29 adjoining both sides, the outer circumference of section 31 forming a snap member for resiliently latching in a snap opening on the inner circumference of the piston skirt and located spaced between the piston lips. The section 32 axially offset inwards with reference to the latter is in contact with an inner shoulder of the piston 12 such that it positively locked against movements directed outwardly. There is provided between the sections 31, 32 a centering section radially slightly reduced with respect thereto which is in contact with the inner circumference of the piston skirt. With respect to the positionally interlocked sections 31, 32 all of the remaining sections 28, 29, 30, 33, 34 are axially and/or radially movable, namely as a result of the working stroke, the return stroke or pressure changes in the chamber 14.

Between the fastening 43 or the sections 31, 32 and the outer face or bottom wall thereof respectively the piston 12 forms by its interior space,via throttling cross-sections separate from chamber 14 and substantially smaller with respect thereto, a chamber 44 in which the sections 29, 33 as well as the valve housing 16 are located and from which the media output leads out from the chamber 14 via the valve 15. Via the throttling cross-sections or through the passages 45 distributed around the circumference the chamber 44 is continually in communicating connection with the chamber 14, the passages 45 by-passing the outer circumference of the sections 31, 32 and may be formed by axial grooves on the inner circumference of the piston 12.

As an abutment for axially and non-rotationally supporting and radially self-centering guidance of the inner end 35 supporting edges are disposed distributed about the circumference which are expediently formed by protrusions, such as ribs 46. These are configured integrally with the housing 3 and protrude from the inside surface of the bottom 27 or the jacket of the chamber respectively so that the medium flowing out of the inner end 35 is able to flow between them with deflection into the opposite direction into the chamber 22 and onto the outer circumference of the sections 28 to 34. The outer circumference of the support 26 defines by the inner circumference of the sections 28, 34, 30 a helical passage 47, the pitch and passage cross-section of which change with the working stroke. Accordingly, the inlet chamber of the chamber 22 and, where applicable, also the inlet chamber of the chamber 14 or of the piston 12 respectively by the outer helix 40 of the section 30, 28, 29 respectively defines a corresponding outer helical passage 48. Each of the helical passages 47, 48 are provided with two turns, and also the helical passage 48 changes its pitch and its cross-section or its volume respectively with the changes in length of the associated section 28, 29, 30 where necessary at least approximately to zero, should axially juxtaposed helical flanks abut at the end of the stroke. The specific deformation of every spring 28, 29, 30 is roughly constant over the full length of their helix 40.

When the chambers 14, 22 and the interior of the working spring 10 are completely filled with medium, an inwardly directed stroke movement of the piston unit 9 results firstly in merely a shortening and torsional stress of the compression springs 28, 30, resulting in the valve housing 18 adjoining both sides of the latter being entrained against the valve seat 19 whilst being slightly rotated. The valve seat 19 is formed by an annular rib against which the opposite face of the valve housing 18 rotatingly abuts following a first partial travel of the stroke and thereby shutting off the valve passage pressure-tight. The shortening of the spring 30 is thereby concluded, and during the further stroke only the spring 28 is still effective, the inner end of which is locked against twisting by the end 35 or the section 34, respectively. However, the valve housing 18 could also work as a kind of gate valve by it coming into sealing engagement by its outer circumference with the inner circumference of the chamber 22 and thereby not being abutment-limited, so that also the spring 30 is subject over the total stroke travel of the piston 12 to changes in torsion or length, respectively.

Following closing of the valve 17 the further stroke movement results in an increase of pressure in the chamber 14 as well as in a diminishing of the cavity of the working spring 10, so that medium is forced out of this cavity via the opening 24 and the passage 23 back into the storage, whilst the pressure in the chamber acts on the section 33 provided as a differential piston, this section carrying the valve housing 16 at its outer face. As soon as this pressure has exceeded a limiting value, the compression spring 29 hitherto of constant length yields with shortening and torsional deformation, so that the valve 15 opens and the medium flows via the outlet passage totally included in the tappet 13 into the head 6 or the outlet nozzle 8, respectively. The pump stroke is terminated by abutment of the piston unit 9 or the head 6 respectively on the base body 2, outside of the chamber however, the valve 15 being instantly closed with return rotation by the valve seat 29. Due to the helical passages 48 and their constriction the medium during its discharge is caused to flow in rotation in the chambers 14, 44 and its flow accelerated by displacement. The outer end of each section 28, 29, 30 respectively may be torsionally opposed by frictional or positive contact, especially with respect to the base body 2 or the piston, respectively.

When the handle 7 is now released, with valve 17 still closed initially, due to the spring 28, the piston 12 executes a first portion of the return stroke in which the chamber 14 is evacuated, whilst the cavity of the working spring 10 is already suctioned via the passage 23 due to enlargement. Subsequently the valve 17 opens due to the spring 30 so that the medium is suctioned with abrupt commencement from the cavity and the chamber 22 into the chamber 14 , until the piston 12 has attained its starting position. The opening 24 is offset outwardly with respect to the valve passage of the valve 17. During this suctioning the medium is in turn caused to flow rotationally within the cavity as well as in the chambers 22, 14, but its flow is retarded. The section 28 is longer than the section 30 and acts as a return spring only on the piston 12, whilst the section 30 acts not only as a valve spring for the valve 17 but also as a return spring for the piston 12. The head 6 is connected fixedly positioned to the piston unit 9 in the axial direction.

The cover 4 is connected by an axially latching snap connector 49 to the housing 3, the sleeve-shaped edge at the outer end of the housing 3 being clasped both at the inner circumference and at the outer circumference of the cover 4. The cover 4 is configured integrally with a fastening member 50 for fastening the base body 2 or the complete apparatus 1 to the storage integrally. The fastening member 50 is a cap spacingly surrounding the body 3 in the portion of the chamber 14 at the outer circumference, this cap being offset inwardly with respect to the outer end of the body 3 and in this case comprising a female thread for the engagement on a male thread on the neck of the storage. The cover 4 is additionally configured integrally with a sleeve-shaped seal 51 which surrounds the body 3 at the outer circumference with a gap spacing and the outer circumference of which is provided for the sealing engagement in the inner circumference of the storage neck. The cover 4 is furthermore configured integral with a raised face 52 having a reduced width with respect to the largest outer width of the apparatus 1 or with respect to the head 6 and the cover respectively, this raised face mounting the snap connector 49, in the starting position of the valve 15, and a portion of the section 29 as well as serving at the outer circumference to radially guide the head 6 which clasps the raised face 52 by its inner circumference in every position. In the pumping stroke end position the head 6 abuts expediently against the outer face of the member 50, from which the raised face 52 protrudes, so that the latter is then totally located within the head 6.

Figure 2:
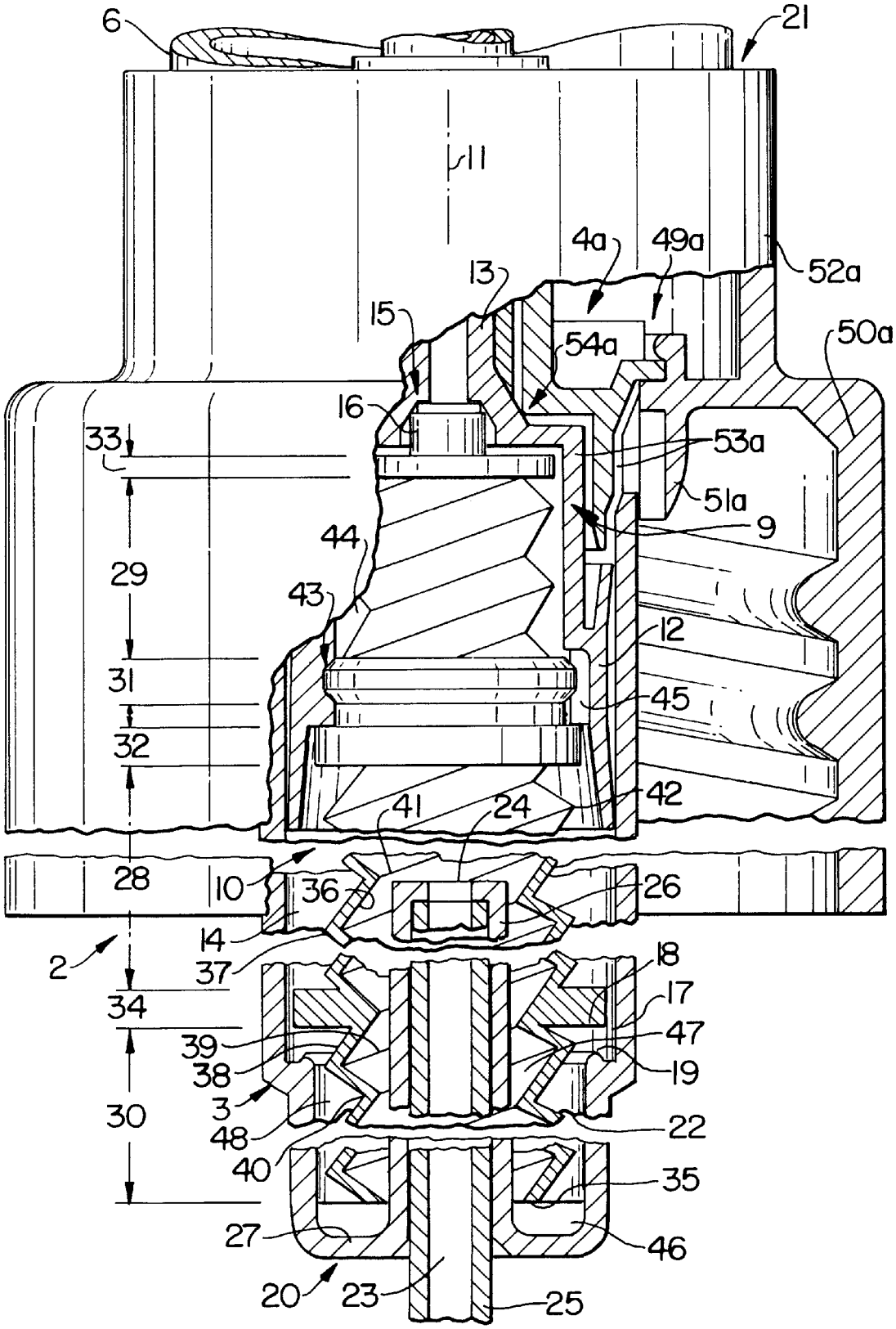
FIG. 2 shows the discharge apparatus according to FIG. 1 in a configuration on a magnified scale and slightly modified.

In accordance with FIG. 2 the parts 50*a*, 51*a*, 52*a*, as compared to the above, are configured integrally with the housing 3, at the outer edge of which they adjoin. The cover 4*a* is located totally within these parts 50*a*, 51*a*, 52*a*, and is secured via the snap connector 49*a*, the cover 4*a* in this case engaging an inner circumference of the snap member of the housing 3 by an inlet chamber of a flange having the shape of an annular disk. The head 6 is radially guided by its outer circumference at the inner circumference of the raised face 52*a* and surrounds in the pumping stroke end position the snap connector 49*a* at the outer circumference, it also abutting against the front wall of the member 50*a*.

To prevent evacuation of the storage due to media discharge a vent is provided which expediently passes through the discharge apparatus 1 or the base body 2 from the outer end and leads along the outer circumference of the pumping chamber jacket directly into the vessel neck as well as from there into the storage space. The ventilation passage 53 runs along the outer circumference of the tappet 13 and of the piston body narrowed with respect to the piston lips, the bottom wall of the piston body directly adjoining the tappet 13 integrally. With respect to these circumferential surfaces and the outer face of said bottom wall inner circumferential and face surfaces of the cover 4 are located as passage definitions having a gap spacing. Between the outer circumference of the tappet 13 and the piston bottom wall a ventilation valve 54 is provided which in the starting position of the actuator 5 is closed pressure-tight by abutment and is instantly open on commencement of actuation. The valve 54 is located roughly in the same axial portion as the valve 15, the movable valve part being configured integral with the tappet 13. The channel 53 is located directly at the inner circumference of that sleeve part of the cover 4 that engages the inner circumference of the housing 3, ports the inner front end of this sleeve part, it then passing through the jacket of the housing 3 between both sleeve parts of the cover 4 and porting between the housing jacket and the seal 51 into the bottleneck. Similarly configured are also the ventilation channel 53*a* and the valve 54*a* in accordance with FIG. 2, in the starting position the rear sleeve-shaped and axially outwards directed sealing lip of the piston 12 being located directly adjacent to the inner end of the cover sleeve and defining together therewith an annular space which with respect to the chamber 14 is closed off pressure-tight as well as forming a section of the ventilation passage.

According to FIGS. 1 and 2, starting from the inner end 35 of the component 10, the scections 30, 34, 28, 32, 29 and 33 are provided in sequence and directly integrally juxtaposed, the sections 30, 28, 29 executing changes in length in operation and the sections 34, 32, 31, 33 not. With the exception of the section 33 all other sections are annular in cross-section and closed in the ring wall. As compared to this, according to FIG. 3, the section 32 is not provided, but merely the section 31*b* and the adjoining centering section. In addition, the section 30*b* need not be configured elongatable, but it may merely permit radial compensating movements. The sleeve-shaped, freely inwards protruding inner piston lip of the piston 12*b* forms in this case the valve seat 19*b* of the valve 17*b*. For this purpose the piston 12*b* or this lip is elongated sufficiently far inwards, so that the sections 28*b*, 34*b* are always located within the piston 12*b*. The outer circumference of section 34*b* rounded as a sliding surface is located slightly spaced away opposite the funnel-shaped conically flared inner circumference 19*b* of the piston lip in the starting position. When the piston 12*b* is moved inwardly, the closing surface 18*b* of the valve housing abuts against the surface 19*b*, and the valve 17*b* is closed. The pump chamber 14*b* is located in this case only within the piston 12*b* and the sections 18*b*, 34*b* form a substantially stationary counterpiston which together with the piston 12*b* cramps the volume of the pump chamber 14*b* on the pump stroke. The abutment 46*b* in this case is elongated so against the piston 12*b*, that in the starting position its outer end is located directly adjacent to the inner piston end. The spring or the section 30*b* respectively may in this case be substantially shorter than its width. This also applies to the annular disk-shaped sections 31 to 34. The section 28 is maximally two to three times longer than its width, and the inner or outer width of the sections 28 to 30 is the same.

Figure 3:
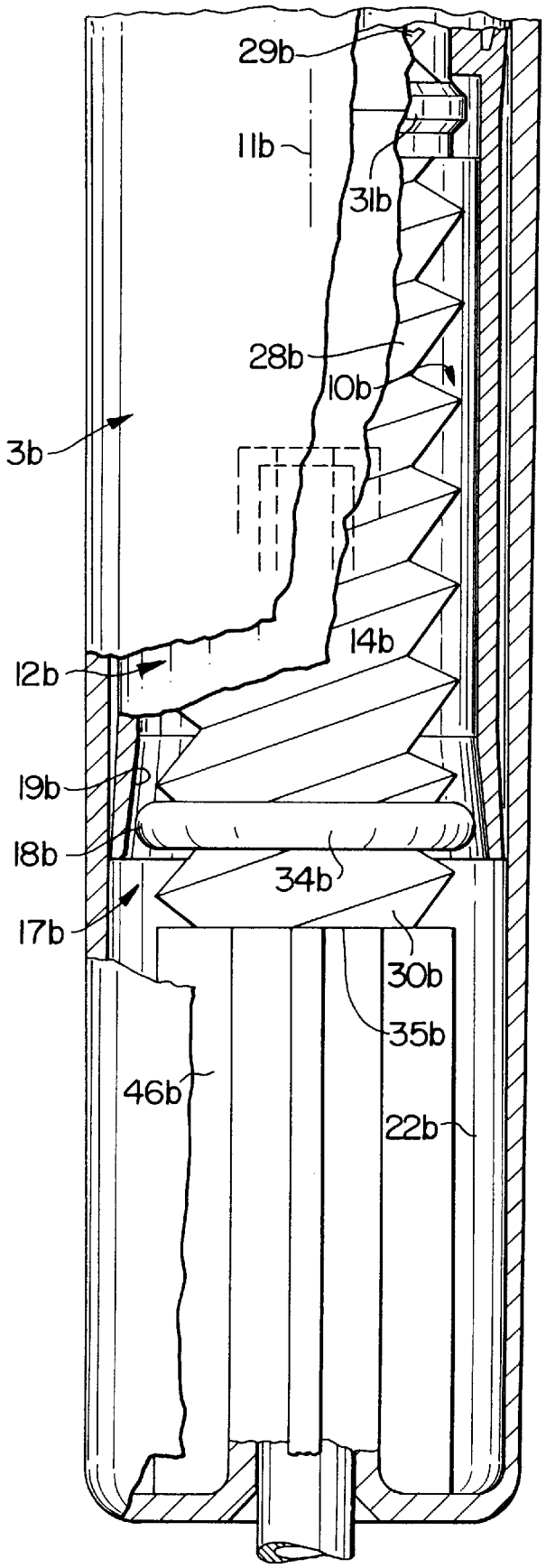
FIG. 3 is a section view of a further embodiment in axial section.
Figure 4:
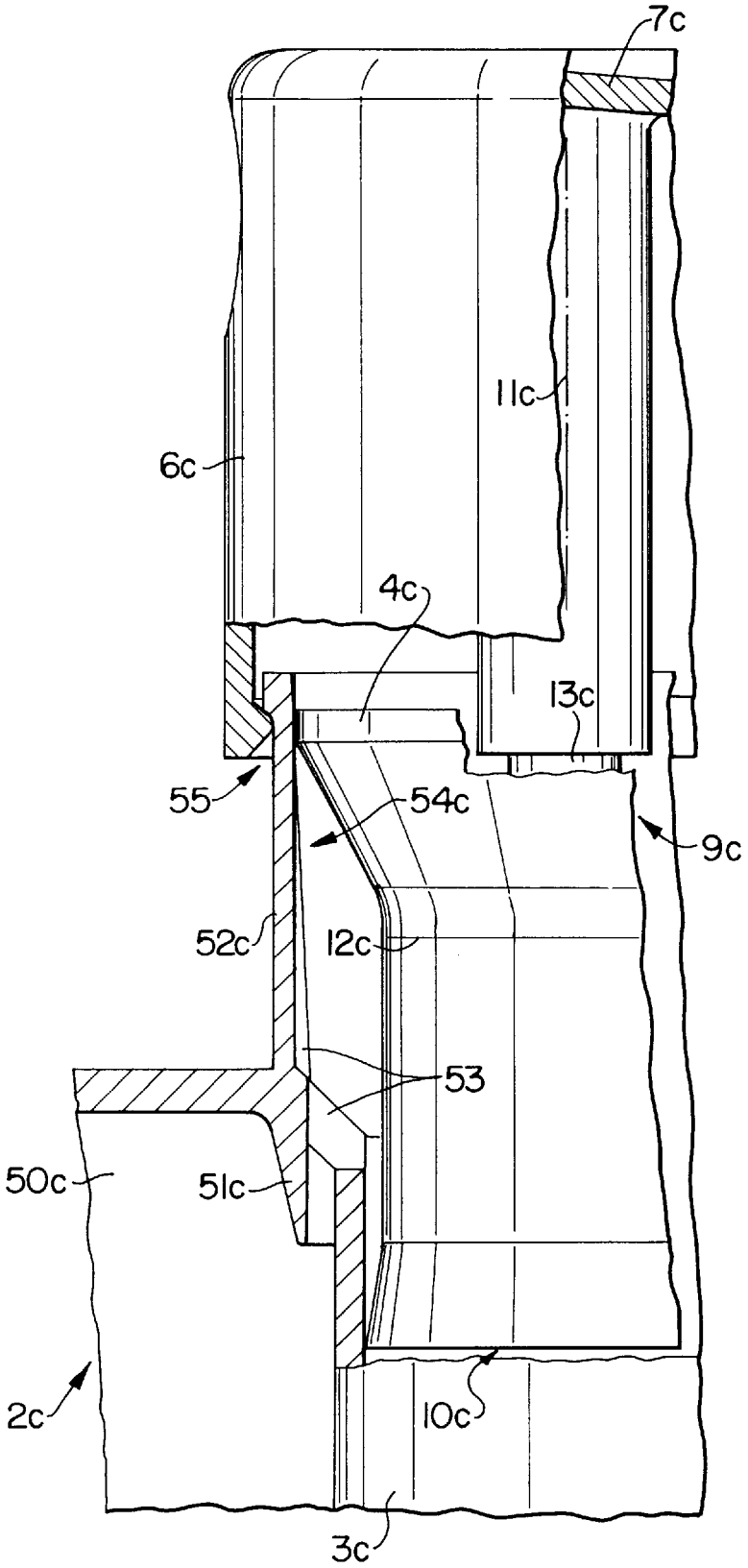
FIG. 4 is a section view of a further embodiment of a housing and FIG. 5 shows a further embodiment of discharge apparatus partly in axial section

In accordance with FIG. 4 a separate cover 5 is not provided, instead the closure 4*c* is formed solely by the outer piston lip of the piston 12*c*, this lip sliding on the inner circumference of the raised face 52*c* with a ring edge and simultaneously forming the valve housing of the valve 54*c*. The inner circumference of the neck 52*c* is provided with longitufinal grooves to form the valve seat or the associated section respectively of the ventilation passage 53, these grooves being opened directly following commencement of the piston stroke by the valve housing in the fashion of a gate valve. In this case the outer piston lip has a greater width than that of the sliding edge of the inner piston lip, whilst the two piston lips according to FIGS. 1 to 3 have the same width. In this case the head 6*c* is locked in place with respect to the full-length integral base body 2*c* by an axial lock 55, particularly with near zero clearance against being removed in the starting position. The lock 55 also serves as an abutment limiting the starting position of the piston unit 9*c* which encloses the head 6*c*. The locking members automatically intersnap together on axial assembly of the parts 2*c* and 6*c* or 9*c* respectively, they being formed by a protruding ring shoulder on the inner circumference of the head jacket and a countershoulder on the outer end as well as on the outer circumference of the raised face 52*c*.

Figure 5:
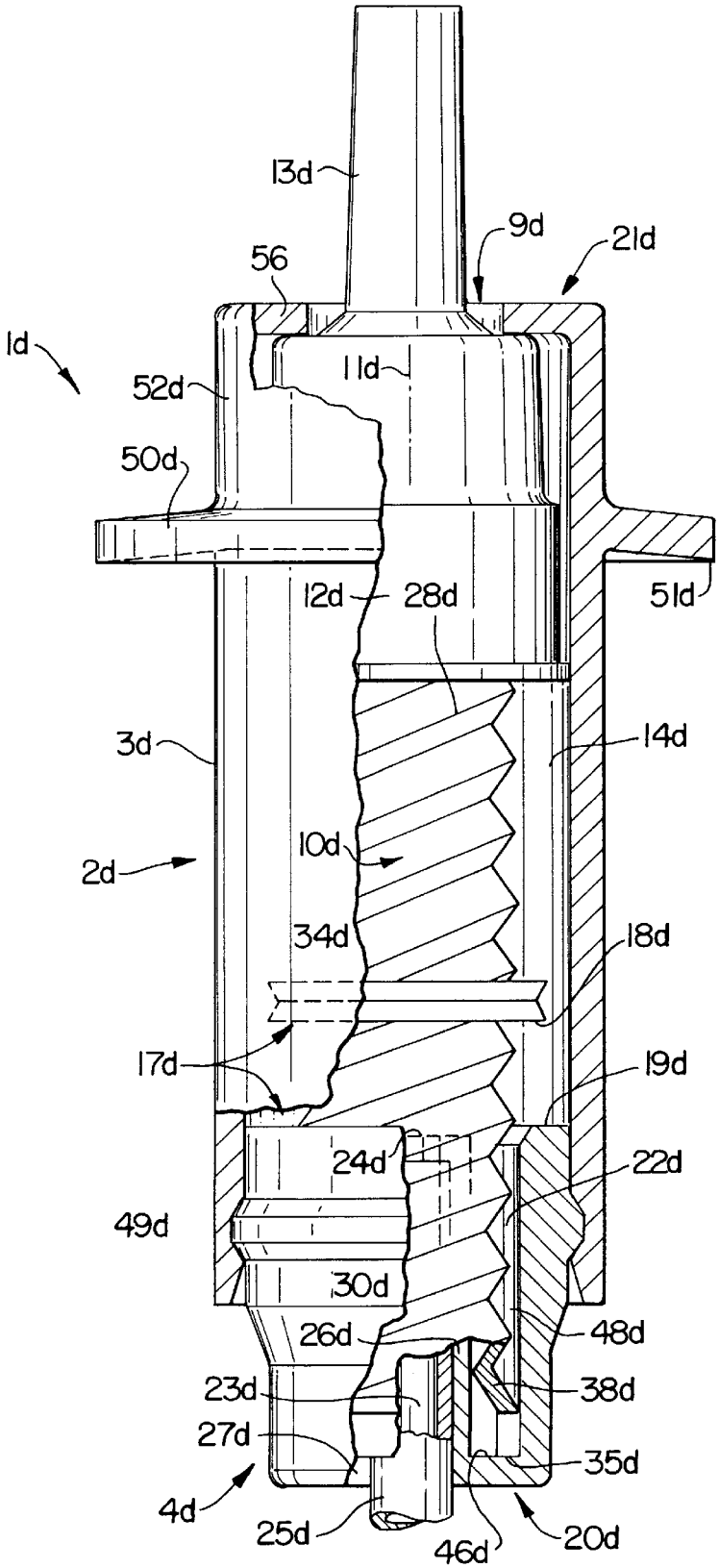

In accordance with FIG. 5 the cover 4*d* is provided locked against twisting at the inner end of the component 2*d* or 3*d* respectively. The cover 4*d* forms by its outer face the valve seat 19*d*, the inlet 24*d*, the support 26*d*, the bottom 27*d* as well as by the inner face thereof the abutment 46*d* and also the outer limit of the chamber 22*d* or of the passage 48*d* respectively. The inner end section of the section 30*d* comprises in the jacket 38*d* axial transition openings through which the medium is able to flow from the cacity of the component 10*d* into the chamber 22*d* and which extend up to the end surface 35*d* or serve locking against twisting, respectively. The housing 3*d* forms at the outer end an integral ring disk-shaped front wall 56 through which the tappet 13*d* passes and against the inner face of which the piston 12*d* abuts in the starting position. The housing 3*d* comprises furthermore at the outer circumference, configured integral therewith, a ring disk-shaped protruding fastening flange 50*d* which in the fashion of a dished washer has the shape of truncated cone. When this fastening member 50*d* is clamped against the outer face of the vessel neck by means of a crimping ring, a screw cap or the like the flange 50*d* is flattened resiliently, its inner face or its outer circumferential edge respectively forming the seal 51*d*.

The configuration of the base body, particularly the arrangement of the cover according to FIG. 5, may also be provided in the embodiments according to FIGS. 1 to 4. The apparatus 1*d* can be very easily assembled, particularly in the upside-down position, because the piston unit 9*d*, the component 10*d* and in conclusion the cover 4*d* can be lowered into the housing 3*d* one after the other, they thereby orienting themselves by their slants self-centering with respect to the housing and with respect to each other, inserting and snapping the cover 4*d* into place also latching the snap connector of the component 10*d*. The cover 4*d* engages the inner circumference of the housing 3*d* via the snap connector 49*d*. The housing has from the chamber 14*d* to the connector 49*d* the same width throughout. The snap connection between the components 10*d*, 12*d* may also be latched not before latching of the cover 4*d*, namely by a stroke of the unit 4*d*, in which the section 34*d* abuts against the face 19*d* and then forms a rigid abutment for the spring 28*d*.

In the FIGS. 1 to 5 the same reference numerals are employed for parts corresponding to each other, but with differing index letters, this being the reason why all parts of the description apply accordingly for all embodiments and all configurations of every embodiment may be provided for each of the remaining embodiments.

In particular in an embodiment in keeping with FIG. 3 it is also possible to guide the outer circumference of the section 28*b* or 30*b* respectively very near to the inner circumference of the piston 12*b* or to allow them to glide thereon, so that a corresponding helical passage of the kind described results. Furthermore, the transition opening between the cavity of component 10*b* and the chamber 22*b* may be formed by at least one transverse opening in the jacket thereof and/or in the section 31 or 32 respectively. If the transition opening is located in the section 28*b* or 30*b* respectively the outer circumference thereof may form together with a section axially offset inwardly with respect to the transition opening the valve housing of the inlet valve. The piston may also comprise at the inner circumference a protruding cam or helical collar which engages directly adjacent to section 32 the helical groove at the outer circumference of the section 28 and thus form a connector corresponding to the snap connector 43. The inlet valve may further comprise a valve seat located within the component 10, e.g. the outer circumference of the tube 25 or of the support 26 on which then at the commencement of the piston stroke an inner circumference of the component 10, e.g. a section 32 or 31 respectively through which a transverse passage passes as the valve housing stops, the transverse channel and thus the connection between the cavity of the component 10 and chamber 14 thereby being closed. In this case, the inlet chamber is formed by this cavity. Instead of the helical configuration of each section 28 to 30 respectively, this may also provided with corresponding annular grooves or other profiled axial sections. each of which is closed over the circumference and located axially justaposed link-like.

What is claim is:

1. A dispenser for media, comprising:

a first abutment;

a second abutment spaced from said first abutment;

a base body supporting said first and second abutments;

a resiliently deformable working spring having a longitudinal axis, said working spring including:

a plurality of working sections extending along said longitudinal axis, said working sections including:

a first stop, said first abutment supporting first second stop, and a second stop spaced from said first stop, said second abutment supporting said second stop, at least one of said working sections being a spring section, said spring section being continuously axially stressed during operation of said dispenser;

said spring section deformable under axial loading transferred by said first and second stops to said first and second abutments;

during operation of said dispenser, a varying torque being applied to said spring section, said torque being resiliently stored by said spring section; and, torque releasing means for operably releasing said stored torque from said spring section.

2. The dispenser according to claim 1, wherein said spring includes subsections, said torque releasing means and said subsections include:

a first subsection, said first subsection including a helical turn extending around said longitudinal axis over a turn angle and being inclined with respect to said longitudinal axis by a pitch angle, said turn angle defining marginal angle flanks;

a second subsection, said second subsection juxtaposed with said first subsection and longitudinally spaced from said first subsection, said first subsection at said marginal angle flanks defining a first subsection end and a second subsection end, said second subsection end spaced from said first subsection end parallel to said longitudinal axis; and, a connecting section extending transverse to said helical turn, said connecting section uninterruptedly connecting said first subsection with said second subsection, said torque releasing means experiencing a torque stress upon expansion and compression of said spring section.

3. The dispenser according to claim 2, wherein in axial cross-section said subsections and said connecting section are made in one part, said connecting section in common with said subsections being deformable.

4. The dispenser according to claim 2, wherein said pitch angle is greater than 10°, whereby said torque is inherently stored in said spring section upon compression of said spring section.

5. The dispenser according to claim 1, wherein:

said spring section includes first and second spring sections;

one of said working sections defines a rigid section inherently stiffer than said first and second spring sections, said spring sections defining opposing first and second spring ends, both said spring ends being resiliently deformable together with said first and second spring sections and with respect to said rigid section, said spring ends rigidly connecting to said rigid section; and, said spring ends and said rigid section being made in one part.

6. The dispenser according to claim 5, wherein:

said spring section has wall cross-sections transverse to said longitudinal axis;

said rigid section defines rigid cross-sections thicker than said wall cross-sections; and, said rigid section including an internal helix made in one part with said rigid section.

7. The dispenser according to claim 5, wherein said first and second spring sections are helical.

8. The dispenser according to claim 5, wherein said rigid section and at least one of said spring ends operably rigidly connect to a further component of said dispenser, said rigid section being connected to said further component by a snap connection, said snap connection including interengaged snap members, said snap members together bounding a passage for the media.

9. The dispenser according to claim 5, wherein:

two of said working sections define respective rigid sections, said rigid sections comprising:

a control member, a valve closing member, an abutment, and a guiding member;

said rigid sections directly connect to said first spring end;

together with said first spring end, said rigid sections are separately resiliently axially displaceable with respect to said second spring end; and, said rigid sections form an intermediate section located between two of said spring sections and an end section, said end section providing an end of said spring assembly.

10. The dispenser according to claim 1, wherein:

said working sections include an inherently non-resilient rigid section;

parallel to said longitudinal axis, said spring section and said rigid section are juxtaposed and directly interconnected in one part; and, said rigid section includes an internal helix made in one part with said rigid section.

11. The dispenser according to claim 10, wherein said rigid section is dimensionally inherently substantially rigid, said helix substantially continuously passing through said rigid section and said spring section.

12. The dispenser according to claim 11, wherein said spring section comprises a multiple-start helix having a first resilient helix and a second resilient helix, said second resilient helix spaced from and adjacent to said first resilient helix.

13. The dispenser according to claim 1, wherein:

in cross-section, said working spring is at least partly annular and defines a jacket around said longitudinal axis, said jacket including circumferential jacket faces having an outer circumference and an inner circumference, at least one of said jacket faces including a profile configuration sloping around said longitudinal axis at a pitch angle of greater than 20°.

14. The dispenser according to claim 1, wherein said spring section defines a spring jacket circumferentially and longitudinally substantially closed, said spring jacket including circumferential jacket faces having an outer circumference and an inner circumference, at least one of said jacket faces including a circumferential groove profile inclined with respect to said longitudinal axis by a pitch angle of greater than 20°.

15. The dispenser according to claim 1, further comprising means for simultaneously axially loading and torquing said spring section when said spring section is longitudinally deformed, said torquing being superimposed onto and increasing said axial loading when said axial loading and said torquing is released.

16. The dispenser according to claim 1, wherein:

said spring section defines an overall spring length and a wall thickness, said wall thickness substantially constant over said spring length; and, said spring section including a pitch profiling oriented at a sloping angle with respect to said longitudinal axis over substantially all of said spring length, said pitch profiling including a coarse pitch.

17. The dispenser according to claim 11, wherein:

said spring assembly comprises a rigid section having a rigid inner circumference;

said spring section longitudinally connects to said rigid section;

said spring section has a pitch profiling continuously extending substantially entirely over said rigid inner circumference; and, said spring section and said rigid section are made in one part.

18. The dispenser according to claim 11, further comprising a manual actuator, said spring section comprises a helical spring, said helical spring including an axial valve control spring and a restoring spring for said manual actuator.

19. The dispenser according to claim 1, wherein said working spring comprises remote circumferential component faces, said component faces including an outer component face and an internal component face, both said circumferential component faces including guiding faces for guiding the medium and said working spring, said spring assembly including a hollow body enclosing at least one passage port for the media.

20. The dispenser according to claim 1, wherein said base body further comprises:

a substantially inherently stiff dispenser casing; and, a thrust piston enveloping said working spring, said spring section including a torsion spring.

21. The dispenser according to claim 20, wherein said base body comprises a casing cover, said casing cover closing said dispenser casing substantially at a casing end, said casing cover displaceably traversed by a piston unit, said casing cover including a tube projection extending inside said spring section for passing the media.

22. The dispenser according to claim 11, wherein said base body includes:

an inlet end;

an outlet end;

a casing component; and, a cover component located substantially at said inlet end, said cover component being traversed by an inlet duct for the medium, said casing component being made in one part and being rigidly connected with said cover component, said casing component and said cover component commonly entirely enveloping said working spring;

said spring section including a torsion spring.

23. A dispenser for discharging media, comprising:

a base body;

a working spring resiliently deformable and including working sections along a longitudinal axis;

at least one of said working sections being a spring section, said spring section positioned against said base body, said spring section having a pre-load and continuously supporting said base body; and, said spring section being operably deformable whereby said operational load adds to said pre-load, said spring section being made from plastic material in one part and including a bellows which is helical.

24. The dispenser according to claim 23, wherein said spring section includes circumferential bellow faces having an outer circumferential face and an inner circumferential face, both said circumferential bellow faces being helical and bounding said media passages for passing the media.

25. The dispenser according to claim 23, wherein said working spring comprises an inherently stiff rigid section, said spring section and said rigid section together including a helical, inner circumferential face.

26. The dispenser according to claim 25, further comprising:

a thrust piston pump assembled from a pump casing and a piston unit, said piston unit having a thrust piston axially displaceable with respect to said pump casing; and, said working spring extending inside said thrust piston and being rigidly connected to said piston unit with a snap connection located inside said thrust piston.

27. The dispenser according to claim 23, further comprising:

an inlet valve;

an outlet valve;

said working spring having remote outermost ends including an upstream end and a downstream end;

said spring section including separately operable restoring springs for restoring said inlet valve and said outlet valve, said restoring spring for said inlet valve including said bellows.

28. The dispenser according to claim 23, wherein said spring assembly comprises:

an outermost component end sealingly closed with respect to an inside of said bellows;

said outermost component end including an end wall and a projection projecting from outside said end wall; and, said dispenser including a valve assembled from valve bodies, one of said valve bodies including said projection, said projection providing a valve closing face.

* * * * *

UNITED STATES PATENT AND TRADEMARK OFFICE

CERTIFICATE OF CORRECTION

PATENT NO. : 6,073,814
DATED : June 13, 2000
INVENTOR(S) : Fuchs

It is certified that error appears in the above-identified patent and that said Letters Patent is hereby corrected as shown below:

Column 1,
Line 6, replace "November 10, 1995" with -- November 11, 1995 --.
Immediately preceding line 21, insert -- Known dispensers for discharging media are too complicated for simple manufacturing and/or fully automatic assembly. Known dispensers require a very large number of parts and can lose functionality as ambient temperature vary. --

Column 4,
Immediately preceding line 36, insert the subtitle -- BRIEF DESCRIPTION OF THE DRAWINGS --.
Line 40, delete the subtitle "BRIEF DESCRIPTION OF THE DRAWINGS".

Column 6,
Line 49, replace "inner" with -- inlet --.
Line 50, replace "circumference" with -- chamber --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*